US009707611B2

(12) United States Patent
Beal

(10) Patent No.: US 9,707,611 B2
(45) Date of Patent: Jul. 18, 2017

(54) APPARATUS FOR BENDING REBAR

(71) Applicant: Craig Geoffrey Beal, North Port, FL (US)

(72) Inventor: Craig Geoffrey Beal, North Port, FL (US)

( * ) Notice: Subject to any disclaimer, the term of this patent is extended or adjusted under 35 U.S.C. 154(b) by 0 days.

(21) Appl. No.: 14/861,342

(22) Filed: Sep. 22, 2015

(65) Prior Publication Data

US 2017/0080470 A1 Mar. 23, 2017

(51) Int. Cl.
*B21D 11/22* (2006.01)
*B21D 11/12* (2006.01)

(52) U.S. Cl.
CPC ..... *B21D 11/22* (2013.01); *B21D 11/12* (2013.01)

(58) Field of Classification Search
CPC ..... B21D 11/22; B21D 11/12; B21D 9/04; B21D 9/16; B21D 9/055; B21D 7/02; B21D 7/16; B21D 7/06; B21D 7/063; B21D 5/16; B60R 9/06
USPC ..... 72/458
See application file for complete search history.

(56) References Cited

U.S. PATENT DOCUMENTS 1,118,056 A * 11/1914 Ross ..... B21D 7/063 72/458
1,393,830 A * 10/1921 Rosenfeld ..... B21D 7/063 72/458
2,605,665 A * 8/1952 Grenat ..... B25F 1/00 72/458
2,817,986 A * 12/1957 Benfield ..... B21D 7/063 72/459
D304,899 S * 12/1989 Liu ..... D8/105
5,105,646 A * 4/1992 Koskinen ..... B21D 7/063 72/390.2
5,113,685 A * 5/1992 Asher ..... A61B 17/7007 140/106

(Continued)

OTHER PUBLICATIONS

Monolithic Rebar Bender—Monolithic Marketplace, http://www.monolithicmarketplace.com/products/monolithic-rebar-bender, captured at archive.org on Jan. 5, 2015.

*Primary Examiner* — Larry E Waggle, Jr.
*Assistant Examiner* — Henry Hong
(74) *Attorney, Agent, or Firm* — McAndrews, Held & Malloy, Ltd.

(57) ABSTRACT

An apparatus for bending elongated members having different horizontal cross-sectional radiuses (e.g., different sizes of rebar) includes an extension portion, a first vise, and a second vise. The extension portion has a proximal region, a distal region, and a first aperture through the proximal region. The first vise has an aperture through the first vise. The second vise has a recessed region. The first aperture is sized to allow the extension portion to mount onto a vehicle hitch. The first vise and the second vise are located distally from the distal region of the extension portion. The aperture of the first vise is sized to accommodate an first elongated member having a horizontal cross-sectional radius (e.g., a first size of rebar). The recessed region of the second vise is sized to accommodate an second elongated member having a horizontal cross-sectional radius (e.g., a second size of rebar different from the first size of rebar). Accordingly, the horizontal cross-sectional radius of the first elongated member is different than the horizontal cross-sectional radius of the second elongated member.

17 Claims, 7 Drawing Sheets

(56) References Cited

U.S. PATENT DOCUMENTS

| | | | | |
|---|---|---|---|---|
| D339,040 | S * | 9/1993 | Piecuch | D8/26 |
| 5,425,259 | A | 6/1995 | Coben | |
| 5,433,356 | A * | 7/1995 | Russell | B25B 1/24 224/519 |
| 6,627,832 | B2 | 9/2003 | Vittone | |
| 6,870,119 | B2 | 3/2005 | Vittone | |
| 7,114,754 | B2 | 10/2006 | Morello | |
| 7,624,608 | B1 | 12/2009 | Karty | |
| 7,673,492 | B2 | 3/2010 | Hough | |
| 8,201,430 | B1 | 6/2012 | Frear | |
| 8,333,097 | B1 | 12/2012 | Frear | |
| 8,713,984 | B2 | 5/2014 | Wilson, Jr. | |
| 2010/0024515 | A1 | 2/2010 | Hough | |
| 2011/0219846 | A1 * | 9/2011 | Chen | B21D 7/063 72/409.19 |
| 2013/0264367 | A1 * | 10/2013 | Hill | B60R 9/06 224/413 |

* cited by examiner

APPARATUS FOR BENDING REBAR

CROSS REFERENCE TO RELATED APPLICATIONS

[Not Applicable]

BACKGROUND

Generally, inventive techniques disclosed herein describe bending an elongated member, such as a piece of rebar. In particular, the inventive techniques disclose a vehicle-mounted apparatus with a plurality of vises used to bend the elongated member.

SUMMARY

According to certain inventive techniques, an apparatus for bending elongated members having different horizontal cross-sectional radiuses (e.g., different sizes of rebar) includes an extension portion, a first vise, and a second vise. The extension portion has a proximal region, a distal region, and a first aperture through the proximal region. The first vise has an aperture through the first vise. The second vise has a recessed region. The first aperture is sized to allow the extension portion to mount onto a vehicle hitch. The first vise and the second vise are located distally from the distal region of the extension portion. The aperture of the first vise is sized to accommodate an first elongated member having a horizontal cross-sectional radius (e.g., a first size of rebar). The recessed region of the second vise is sized to accommodate an second elongated member having a horizontal cross-sectional radius (e.g., a second size of rebar different from the first size of rebar). Accordingly, the horizontal cross-sectional radius of the first elongated member is different than the horizontal cross-sectional radius of the second elongated member.

The extension portion may also have a second aperture through the proximal region. The section aperture is sized to allow the extension portion to mount onto the vehicle hitch. The second aperture of the extension portion may be oriented at approximately 90 degrees from the first aperture of the extension portion. The first aperture and the second aperture of the extension portion may be offset along a longitudinal dimension along the extension portion such that the first aperture and the second aperture of the extension portion do not intersect.

An upper region of the aperture of the first vise may have a varying horizontal cross-sectional radius. A lower region of the aperture of the first vise may also have a varying horizontal cross-sectional radius.

The first vise may abut the distal region of the extension portion. The second vise may abut the first vise. The apparatus may be formed from one solid piece (e.g., ductile iron).

According to certain inventive techniques, an apparatus for bending elongated members having different horizontal cross-sectional radiuses (e.g., different sizes of rebar) includes an extension portion, a first vise, a second vise, and a third vise. The extension portion has a proximal region, a distal region, and a first aperture through the proximal region. The first vise has an aperture through the first vise. The second vise has a recessed region. The first aperture is sized to allow the extension portion to mount onto a vehicle hitch. The first vise and the second vise are located distally from the distal region of the extension portion. The aperture of the first vise is sized to accommodate an first elongated member having a horizontal cross-sectional radius (e.g., a first size of rebar). The recessed region of the second vise is sized to accommodate an second elongated member having a horizontal cross-sectional radius (e.g., a second size of rebar different from the first size of rebar). The recessed region of the third vise is sized to accommodate an third elongated member having a horizontal cross-sectional radius (e.g., a third size of rebar different from the first and second sizes of rebar). Accordingly, the horizontal cross-sectional radiuses of the first elongated member, the second elongated member, and the third elongated member are different.

The extension portion may also have a second aperture through the proximal region. The section aperture is sized to allow the extension portion to mount onto the vehicle hitch. The second aperture of the extension portion may be oriented at approximately 90 degrees from the first aperture of the extension portion. The first aperture and the second aperture of the extension portion may be offset along a longitudinal dimension of the extension portion such that the first aperture and the second aperture of the extension portion do not intersect.

An upper region of the aperture of the first vise may have a varying horizontal cross-sectional radius. A lower region of the aperture of the first vise may also have a varying horizontal cross-sectional radius.

The first vise may abut the distal region of the extension portion. The second vise may abut the first vise. The third vise may also abut the first vise. The apparatus may be formed from one solid piece (e.g., ductile iron).

Figure 1:
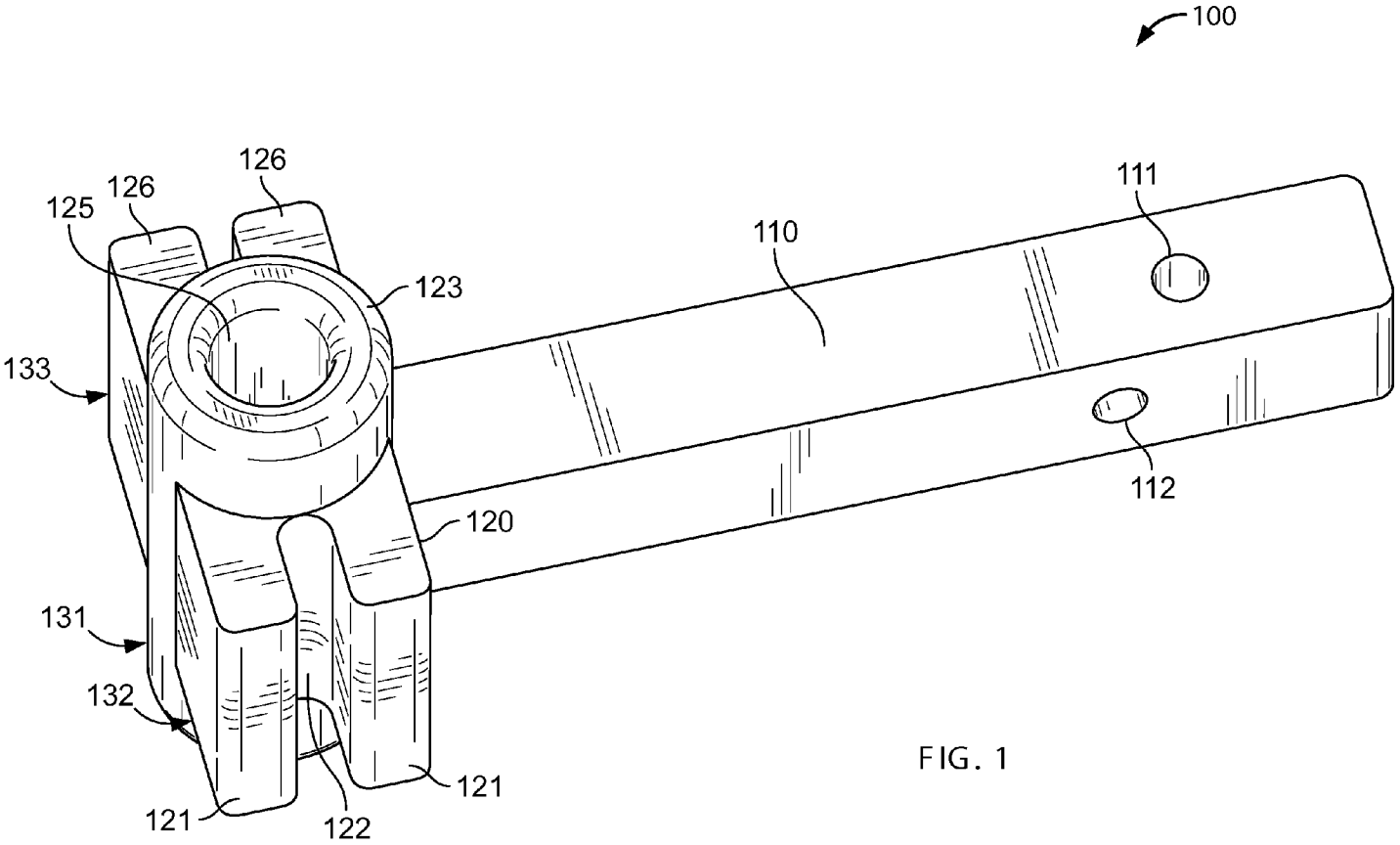
FIG. 1 depicts a perspective view of an apparatus for bending elongated members having different sizes (e.g., different sizes of rebar).
Figure 2:
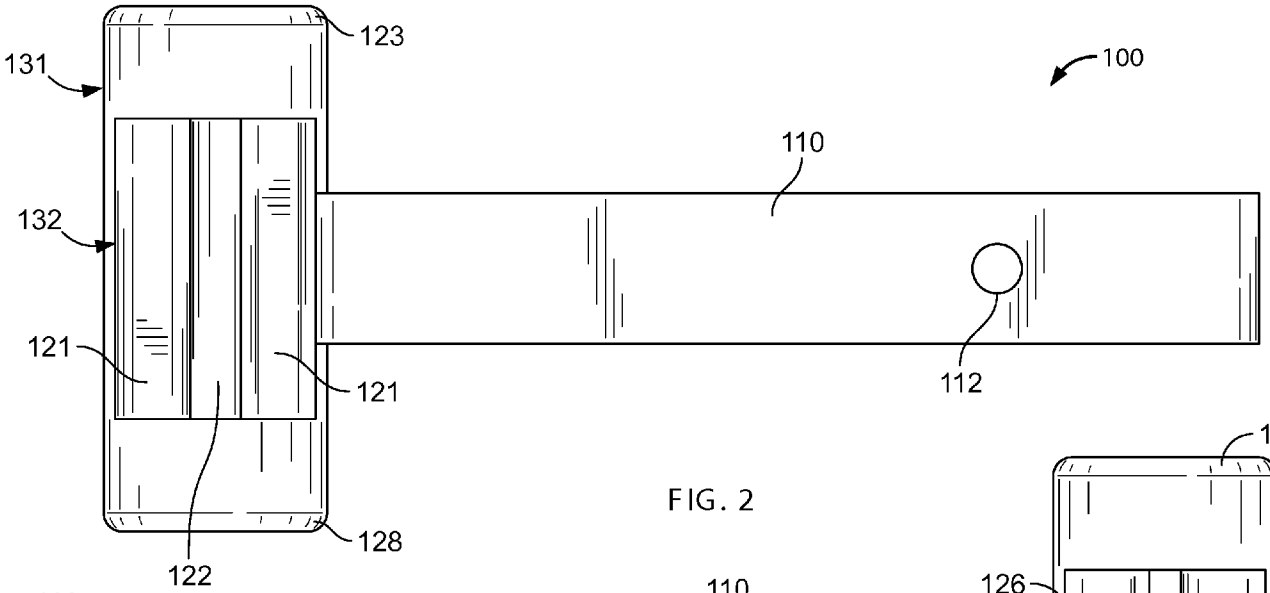
FIG. 2 depicts an elevational view of a right side of the apparatus of FIG. 1.
Figure 3:
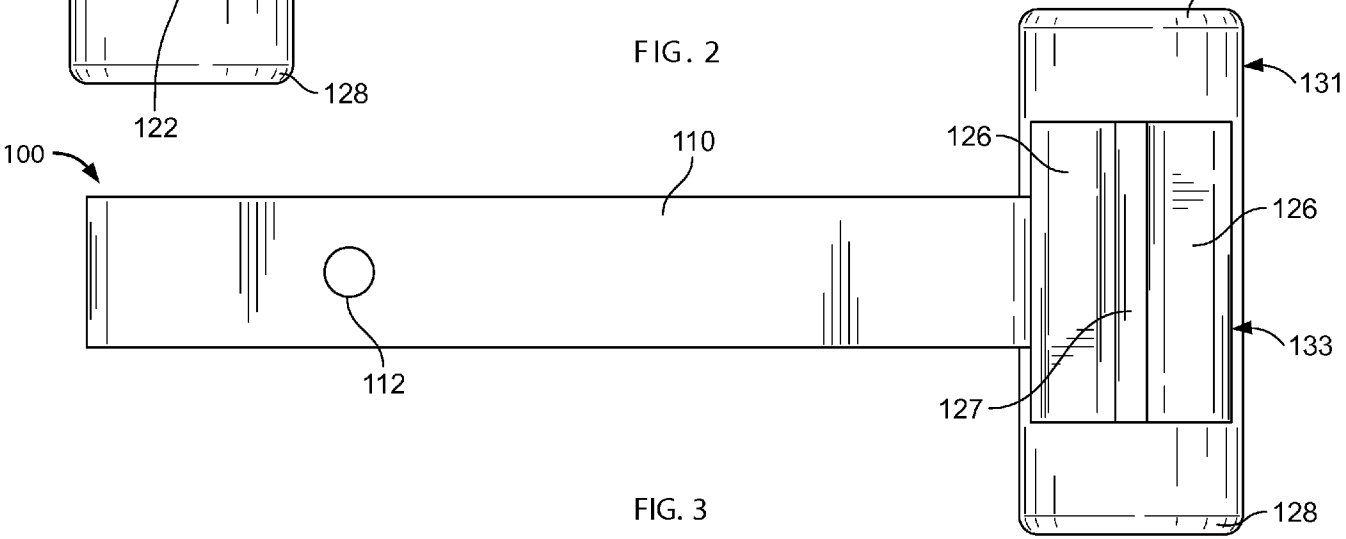
FIG. 3 depicts an elevational view of a left side of the apparatus of FIG. 1.
Figure 5:
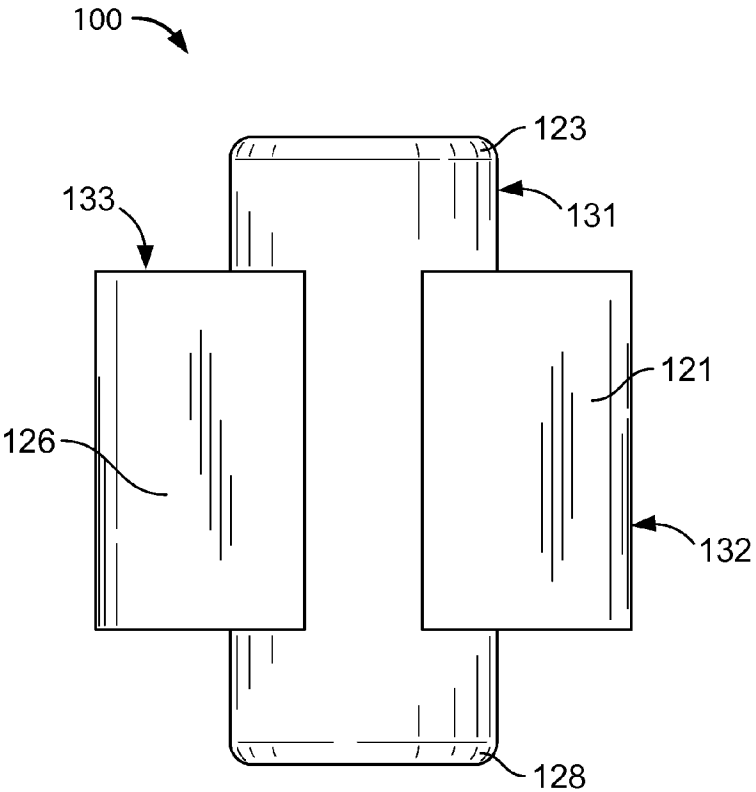
FIG. 5 depicts an elevational view of a front side of the apparatus of FIG. 1.
Figure 4:
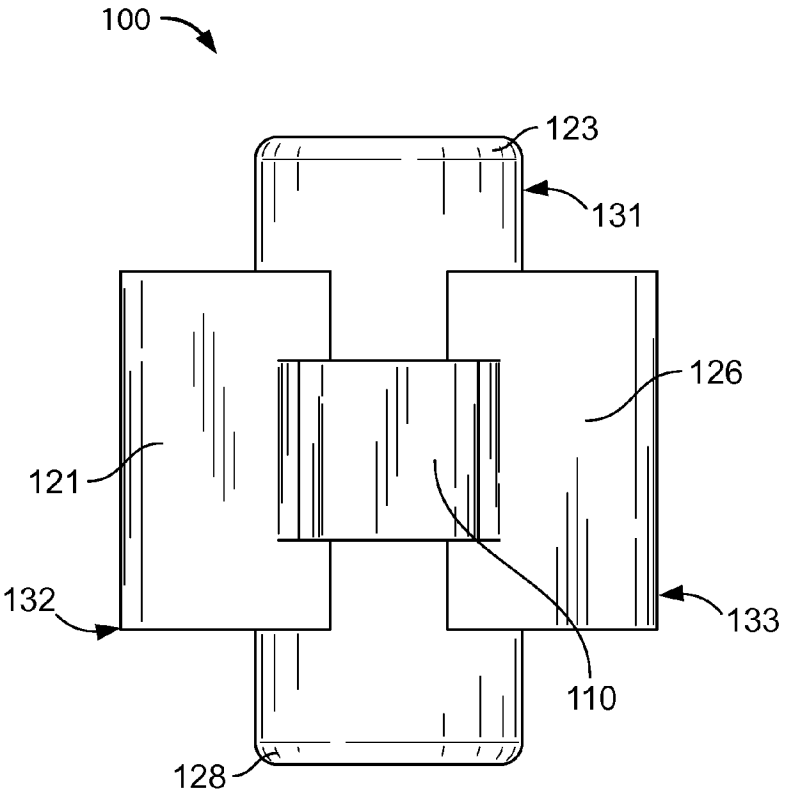
FIG. 4 depicts an elevational view of a rear side of the apparatus of FIG. 1.
Figure 6:
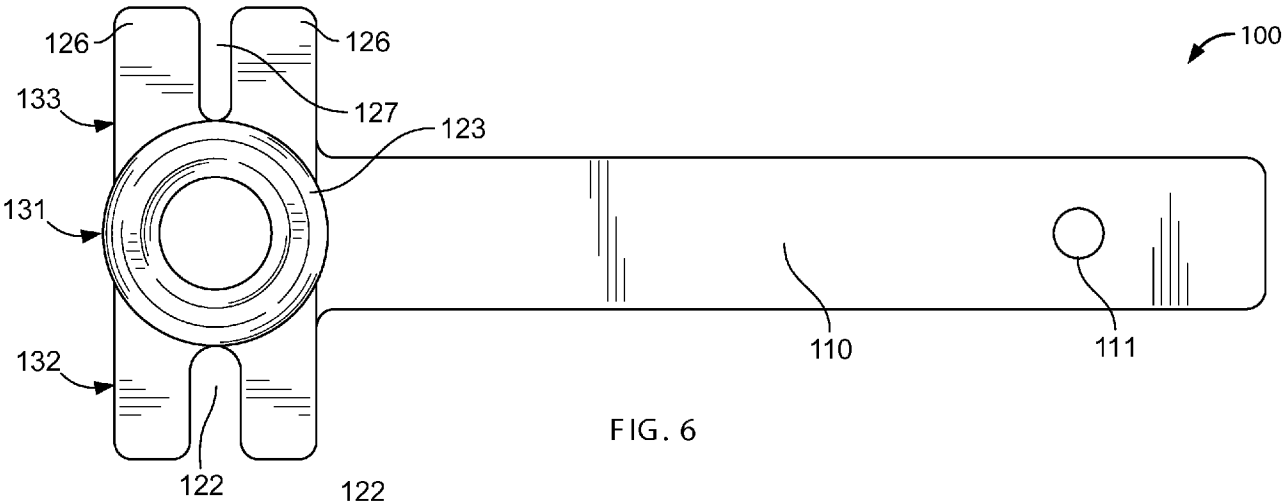
FIG. 6 depicts an plan view of a top side of the apparatus of FIG. 1.
Figure 7:
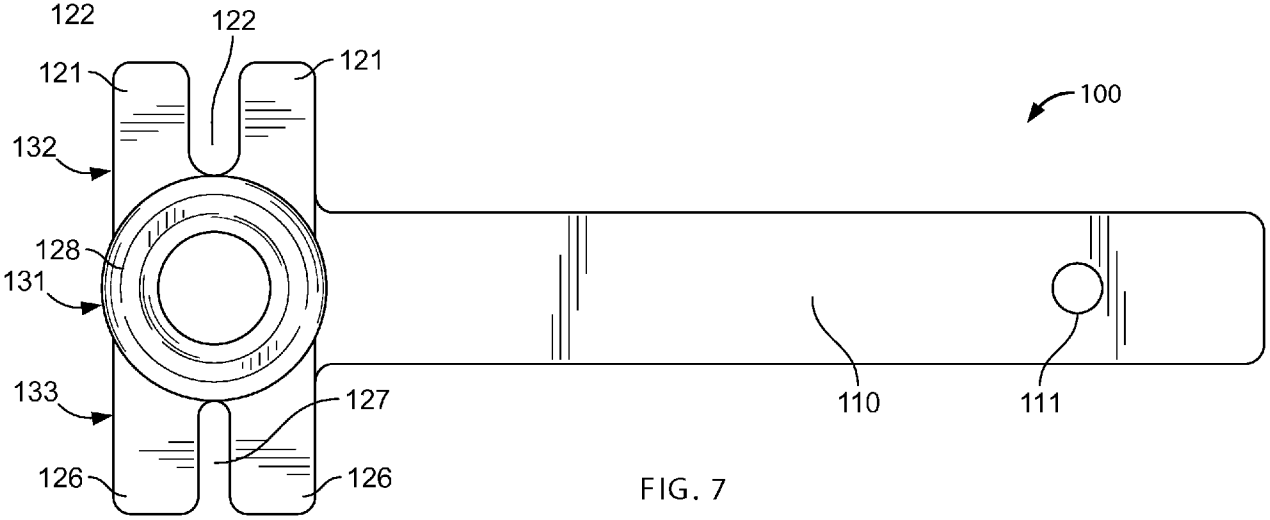
FIG. 7 depicts an plan view of a bottom side of the apparatus of FIG. 1.

The foregoing summary, as well as the following detailed description of certain techniques of the present application, will be better understood when read in conjunction with the appended drawings. For the purposes of illustration, certain techniques are shown in the drawings. It should be understood, however, that the claims are not limited to the arrangements and instrumentality shown in the attached drawings. Furthermore, the appearance shown in the drawings is one of many ornamental appearances that can be employed to achieve the stated functions of the system.

DETAILED DESCRIPTION

FIGS. 1-7 illustrate different views (as described above) of an apparatus 100 for bending elongated members, according to certain inventive techniques.

The apparatus 100 may include an extension portion 110 and a head portion 120. The extension portion 110 may include a distal region proximate the head 120 portion and a proximal region distant from the head portion 120. The extension portion 110 may be a rectangular solid (as shown), cylindrical, or other suitable shapes. The extension portion 110 may be 2 inches deep and/or 2 inches high. The head portion 120 may be 6 inches deep and 7 inches high. The apparatus 100 may be formed of separate pieces or one solid piece. For example, the apparatus 100 may be formed of one solid piece of ductile iron.

The extension portion 110 may include a first aperture 111 in the proximal region that extends through the extension portion 110. The extension portion 110 may include a second aperture 112 in the proximal region that extends through the extension portion 110. The apertures 111, 112 may each be sized to allow the extension portion 110 (and thus the apparatus 100) to mount onto a vehicle hitch. The apertures 111, 112 may each have a diameter of 11/16 inch. The second aperture 112 may be oriented at approximately 90 degrees from the first aperture 111. This may allow the apparatus 100 to be mounted in a horizontal configuration (by using the first aperture 111 for mounting) or a vertical configuration (by using the second aperture 112 for mounting). The orientation of the apertures 111, 112 with respect to each other need not be exactly 90 degrees. The concept is to allow the apparatus 100 to be mounted in two different geometrical configurations to suit the needs of a user who will be bending an elongated member. Furthermore, additional apertures may be included through the extension portion 110 to allow for additional mounting configurations (e.g., at a 45 degree angle). The apertures 111, 112, may be offset along a longitudinal dimension of the extension portion 110 such that the apertures 111, 112 do not intersect. For example, the center of the first aperture 111 may be spaced 2.5 inches away from the proximal edge of the extension portion 110 along the longitudinal dimension of the extension portion 110. As another example, the center of the second aperture 112 may be spaced 3.5 inches away from the proximal edge of the extension portion 110 along the longitudinal dimension of the extension portion 110. Thus, the apertures 111, 112 are spaced 1 inch away from each other. If additional apertures are included, these may also be offset along a longitudinal dimension of the extension portion 110 such two or more of the apertures do not intersect.

The head portion 120 may include a plurality of vises. As used herein, a vise may be any arrangement of material that may accept an elongated member, such that some of the elongated member is within the vise and some of the elongated member is outside of the vise. A vise may stabilize the elongated member, such that a user can apply force to the elongated member at a position outside of the vise, thereby causing the elongated member to bend. A plurality of vises may be included in the head portion 120, such that two or more of the vises abut each other. Two or more of plurality of vises may also be separated from each other (i.e., not abutting). Thus, the head portion 120 may be a plurality of distinct portions.

The head portion 120 may include two or more vises. As shown in the embodiment of FIGS. 1-7, the head portion 120 includes three vises, but there may be two, four, five, etc. As shown and will be further described, the first vise 131 may abut the extension portion 110, the second vise 132 may abut the first vise 131, and the third vise 133 may abut the first vise 131. Other configurations are possible, however. For example, the second and/or third vises 132, 133 may abut the extension portion 110 and the first vise 131, or they may only abut the extension portion 110.

The first vise 131 may be cylindrical (as shown) or may have other shapes (e.g., a rectangular solid). The first vise 131 may be 3 inches wide and 7 inches high. It may include an aperture 125 that extends through the first vise 131. The distance from the proximal edge of the extension portion 110 and the center of the aperture 125 may be approximately 14 inches. The aperture 125 may have a primary diameter of ¾ inch, or may otherwise be sized to accept elongated members having various horizontal cross-sectional radiuses (e.g., #3, #4, and/or #5 size rebar, which have cross-sectional radiuses of ⅜", ½", and ⅝", respectively). The upper region 123 of the first vise 131 may have a varying cross-sectional radius or diameter. Similarly, the lower region 128 of the first vise 131 may also have a varying cross-sectional radius or diameter. While the aperture 125 may have a substantially constant diameter, the shape of the upper region 123 and/or lower region 128 of the first vise 131 may gradually enlarge the diameter in the upper and/or lower regions 123, 128 of the first vise 131. The upper and/or lower regions 123, 128 provide a rounded surface around which bends can be made.

The second vise 132 may include two projection portions 121, which form together a recessed region 122. The projection portions 121 may each be 1 inch wide and 4 inches high. The recessed region may be 1.5 inches deep. As shown, the recessed region 122 is rounded on the inside and is substantially flat on two sides as it extends outwardly to the edge of the apparatus 100. The recessed region may have a width of 11/16 inch, or may otherwise be sized to accept size 4 and 5 rebar.

The third vise 133 may include two projection portions 126, which form together a recessed region 127. The projection portions 126 may each be 1.125 inch wide and 4 inches high. The recessed region may be 1.5 inches deep. As shown, the recessed region 127 is rounded on the inside and is substantially flat on two sides as it extends outwardly to the edge of the apparatus 100. The recessed region may be sized to accept size 3 rebar.

Figure 8A:
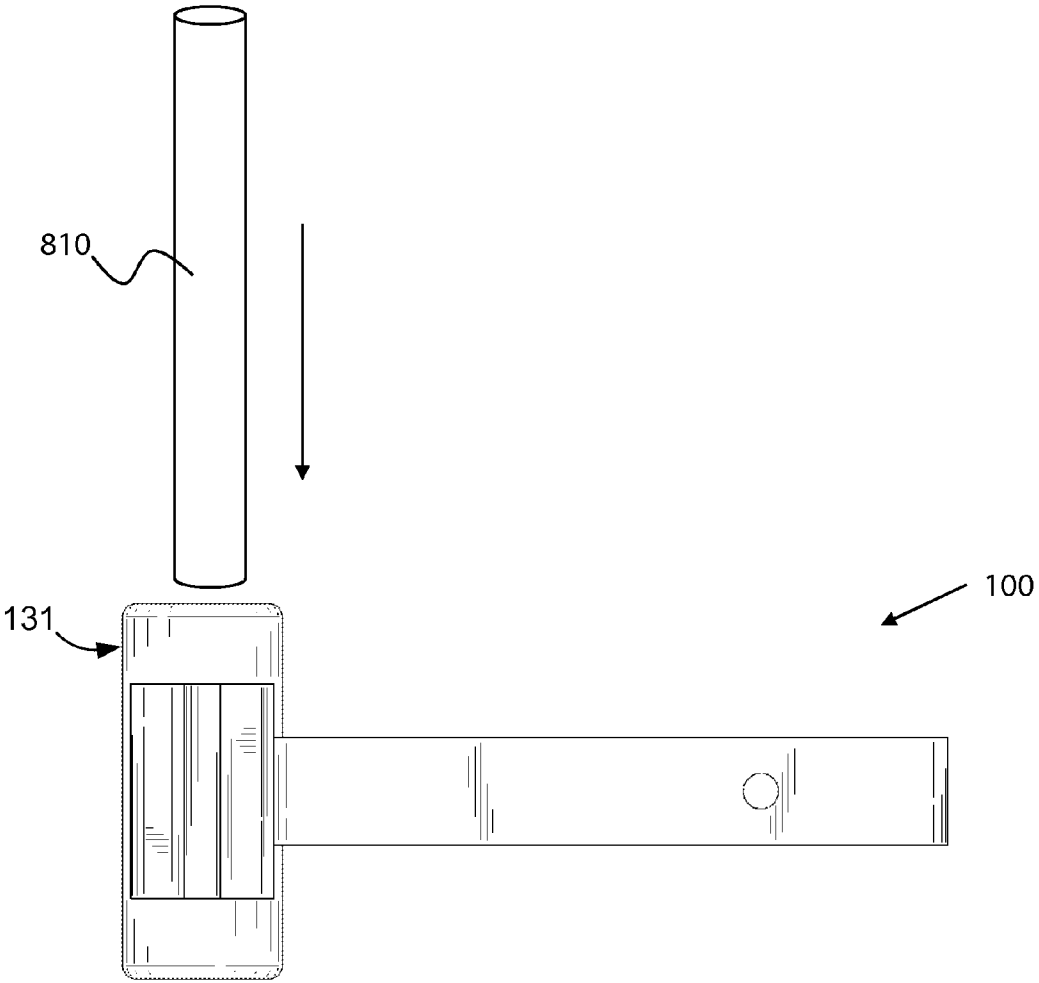
FIGS. 8A, 8B, and 8C depict a method for operating the apparatus of FIG. 1.
Figure 8B:
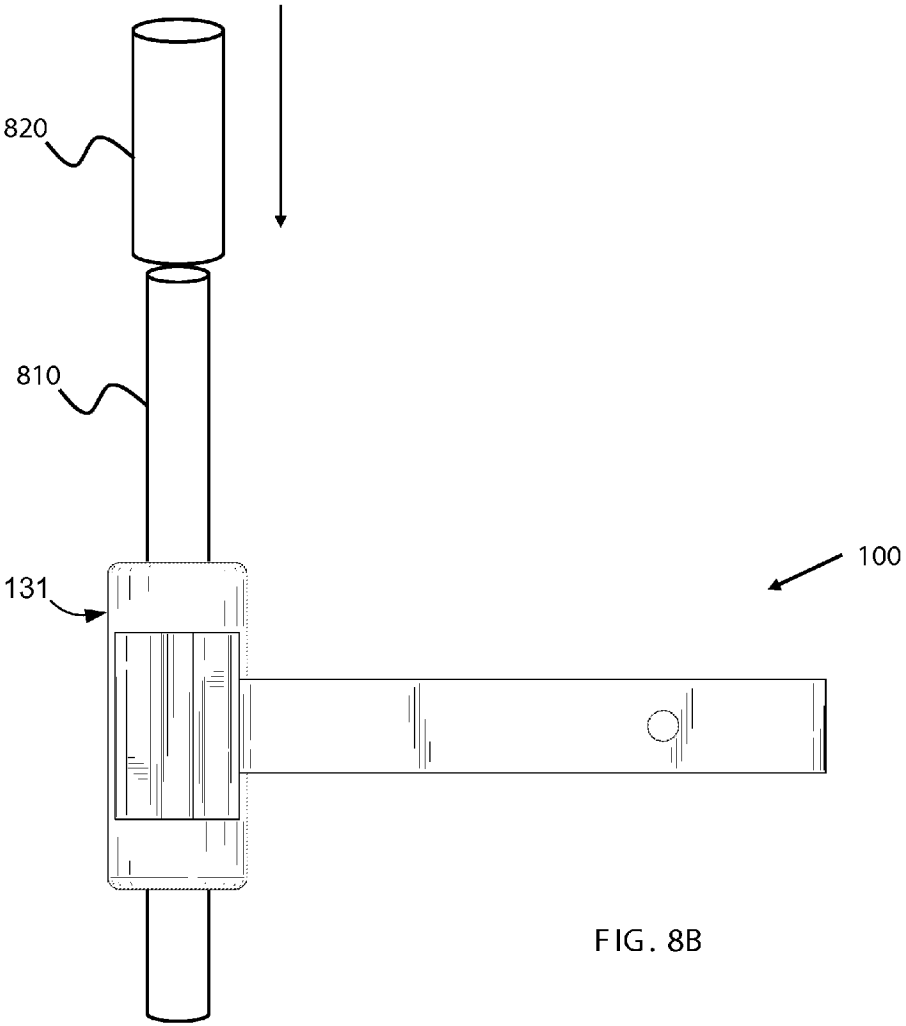
Figure 8C:
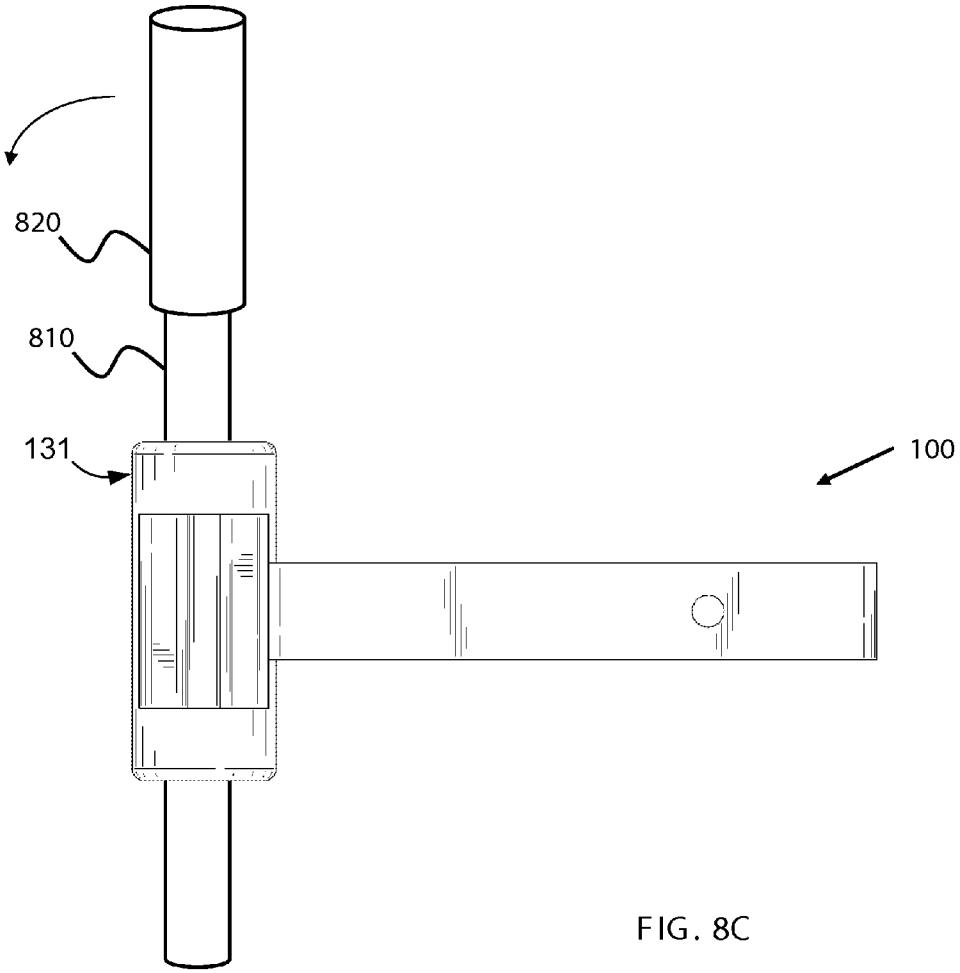

FIGS. 8A, 8B, and 8C depict a method for operating the apparatus 100. As shown in FIG. 8A, an elongated member 810 is inserted into the apparatus (in this case, into the first vise 131). As shown in FIG. 8B, after the elongated member 810 is inserted into the first vise, a bending facilitating piece 820 (e.g., a tube, such as a piece of pipe) is placed over a portion of the elongated member 810 above the apparatus 100. Such a bending facilitating piece 820 may be a pipe, such as steel pipe (e.g., 46 inch long×1.25 inch inside diameter schedule 40 galvanized steel pipe). As shown in FIG. 8C, the bending facilitating piece 820 can then be pulled away (e.g., pulled by a person) from the apparatus 100 to form a bend in the elongated member 810.

In accordance with certain inventive techniques, the apparatus 100 may be used in the following manner. One of the apertures 111, 112 goes into the trailer hitch of any vehicle that has a 2 inch receiver-type hitch. This varies from Class III to Class V hitches. To configure the apparatus 100 in a horizontal orientation (as depicted in the figures), aperture 111 is used, while aperture 112 is used to configure the apparatus 100 in a vertical orientation.

The user then determines the types of bends required and the lengths of bars to be bent and selects either the vertical configuration or horizontal configuration. Short bars may be considered rebar size #3 to #5 less than 10 feet in length. Long bars may be over 10 feet in length. A trailer hitch pin (e.g., ⅝ inch pin) may secure the apparatus 100 to the vehicle trailer hitch.

The user takes the rebar and places it into one of the vises, sliding it to adjust to a bending point on the rebar and the top of the selected vise. The user slides the bending facilitating piece over the rebar up to the point of the bend or top of the selected vise. The user grasps the bending facilitating member on the opposite end away from the vise/bending point and applies pressure to the metal rebar, thereby bending the rebar to the desired angle. The user slides the bending facilitating member off the rebar and verifies accuracy of the angle of the bend and removes the free end of the rebar from the vise.

The first vise 131 may be utilized for the most common type of rebar single bends 0° to 180° and requires a straight end so it can be removed from the vise. Vises 132 and/or 133 can be utilized for rebar shapes requiring more than one bend.

In the case that second or third vises 132, 133 are used, the user determines the size of rebar required to be bent, which in turn determines which open vise will be selected. The operation of bending using vises 132, 133 may be identical except that the size and diameter of the rebar determines the selected vise.

The horizontal position of second vise 132 and/or third vise 133 may offer the consumer the most versatile arrangement for multiple bends on a single piece of rebar. Bending special shapes such as stirrups, hook bars, and Z-shaped and U-shaped bars can be accomplished. The user may: (1) cut the bar to the required length including all bends; (2) mark the bending point on the rebar; and (3) insert the rebar into the selected vise aligning the bending point on the right or left side of the end of the vise. The user may slide the bending facilitating piece over the second end of the rebar extending beyond the vise up to the point of bend or edge of the vise. The consumer may apply pressure to the bending facilitating piece to bend the second end of the rebar to the desired angle required. The user may then remove the rebar from the vise and determine the next required angle to be bent. The consumer will position the rebar work piece at the next bending point and continue as described above to achieve the desired bends and shape of rebar required.

In accordance with the description above, the apparatus 100 may be a durable, solid cast ductile iron compact portable tool for bending concrete steel reinforcement up to size #5 grade 60 rebar (or other elongated members). It requires simple set up utilizing a vehicle mounted 2 inch standard trailer hitch to operate. No additional electric or hydraulic power may be needed. The apparatus 100 may have three separate vises 131, 132, and 133 to bend a variety of shapes and sizes utilized in concrete construction, uncommon in other similar manual rebar benders. It contains no moving parts or pivoting axis points to wear out or replace or need lubrication. The first vise 131 is designed to produce the most commonly used bend in concrete construction—the 90° bend for change of direction or standard termination hooks, and single bends up to 180° in one bend utilizing the horizontal vise position.

The second and third vises 132, 133 are open vises. The 4 inch height of the vise may be useful to provide the proper dimension to utilize bending on each side of the vise for "U" shaped bars or stirrups (e.g., for 8 inch wide tie beams). Additional complicated rebar shapes for step downs in footings and beams and other shapes requiring multiple bends are easily fabricated utilizing the second and third vises 132, 133.

The strength and durability of the solid cast ductile iron bending tool along with its compact size allows for reduced storage space requirements in a vehicle tool box. The quick and easy setup of locking the tool in the vehicle hitch with one hitch pin and three separate vises 131, 132, 133 to utilize for various shapes in the horizontal and vertical orientations makes this tool particularly advantageous.

It will be understood by those skilled in the art that various changes may be made and equivalents may be substituted without departing from the scope of the novel techniques disclosed in this application. In addition, many modifications may be made to adapt a particular situation or material to the teachings of the novel techniques without departing from its scope. For example, although rebar is primarily disclosed as being an elongated member, the inventive techniques could be used to bend other elongated members, such as conduits or copper pipes. Therefore, it is intended that the novel techniques not be limited to the particular techniques disclosed, but that they will include all techniques falling within the scope of the appended claims.

The invention claimed is:

1. An apparatus comprising:

an extension portion including a proximal region, a distal region, and a first aperture through the proximal region;

a first vise including an aperture through the first vise;

a second vise including a recessed region; and wherein:

the first aperture of the extension portion is sized to receive a hitch pin to allow the extension portion to mount onto a vehicle hitch;

the first vise is located distally from the distal region of the extension portion;

the first vise has no moving parts;

the second vise is located distally from the distal region of the extension portion;

the second vise has no moving parts;

the aperture of the first vise is sized to accommodate a first elongated member having a horizontal cross-sectional radius;

the recessed region of the second vise is sized to accommodate a second elongated member having a horizontal cross-sectional radius;

the horizontal cross-sectional radius of the first elongated member is different than the horizontal cross-sectional radius of the second elongated member;

the recessed region of the second vise includes a top opening, a bottom opening, and a lateral opening between the top opening and the bottom opening;

the first aperture of the extension portion is completely surrounded laterally;

the extension portion includes a second aperture through the proximal region;

the second aperture is sized to receive the hitch pin to allow the extension portion to mount onto the vehicle hitch; and the second aperture of the extension portion has a different radial orientation from the first aperture of the extension portion.

2. The apparatus of claim 1, wherein the first aperture and the second aperture of the extension portion are offset along a longitudinal dimension of the extension portion such that the first aperture and the second aperture of the extension portion do not intersect.

3. The apparatus of claim 1, wherein an upper region of the aperture of the first vise has a varying horizontal cross-sectional radius.

4. The apparatus of claim 3, wherein a lower region of the aperture of the first vise has a varying horizontal cross-sectional radius.

5. The apparatus of claim 1, wherein the first vise abuts the distal region of the extension portion.

6. The apparatus of claim 5, wherein the second vise abuts the first vise.

7. The apparatus of claim 1, wherein the apparatus is formed from one solid piece.

8. The apparatus of claim 7, wherein the apparatus comprises ductile iron.

9. An apparatus comprising:

an extension portion including a proximal region, a distal region, and a first aperture through the proximal region;

a first vise including an aperture through the first vise;

a second vise including a recessed region;

a third vise including a recessed region; and wherein:

the first aperture of the extension portion is sized to receive a hitch pin to allow the extension portion to mount onto a vehicle hitch;

the first vise is located distally from the distal region of the extension portion;

the first vise has no moving parts;

the second vise is located distally from the distal region of the extension portion;

the second vise has no moving parts;

the third vise is located distally from the distal region of the extension portion;

the aperture of the first vise is sized to accommodate a first elongated member having a horizontal cross-sectional radius;

the recessed region of the second vise is sized to accommodate a second elongated member having a horizontal cross-sectional radius;

the recessed region of the third vise is sized to accommodate a third elongated member having a horizontal cross-sectional radius;

the horizontal cross-sectional radius of the first elongated member, the horizontal cross-sectional radius of the second elongated member, and the horizontal cross-sectional radius of the third elongated member are different from each other;

the recessed region of the second vise includes a top opening, a bottom opening, and a lateral opening between the top opening and the bottom opening;

the first aperture of the extension portion is completely surrounded laterally;

the extension portion includes a second aperture through the proximal region;

the second aperture is sized to receive the hitch pin to allow the extension portion to mount onto the vehicle hitch; and the second aperture of the extension portion has a different radial orientation from the first aperture of the extension portion.

10. The apparatus of claim 9, wherein the first aperture and the second aperture of the extension portion are offset along a longitudinal dimension of the extension portion such that the first aperture and the second aperture of the extension portion do not intersect.

11. The apparatus of claim 9, wherein an upper region of the aperture of the first vise has a varying horizontal cross-sectional radius.

12. The apparatus of claim 11, wherein a lower region of the aperture of the first vise has a varying horizontal cross-sectional radius.

13. The apparatus of claim 9, wherein the first vise abuts the distal region of the extension portion.

14. The apparatus of claim 13, wherein the second vise abuts the first vise.

15. The apparatus of claim 14, wherein the third vise abuts the first vise.

16. The apparatus of claim 9, wherein the apparatus is formed from one solid piece.

17. The apparatus of claim 16, wherein the apparatus comprises ductile iron.

* * * * *